US005219308A

United States Patent [19]

Rothhammer

[11] Patent Number: 5,219,308

[45] Date of Patent: Jun. 15, 1993

[54] LIGHTWEIGHT NON-INFLATABLE FLOTATION DEVICE

[76] Inventor: Reed Rothhammer, 2635 Edgeview La., Arroyo Grande, Calif. 93420

[21] Appl. No.: 905,815

[22] Filed: Jun. 29, 1992

[51] Int. Cl.[5] ..... B63C 9/08

[52] U.S. Cl. ..... 441/88; 441/125

[58] Field of Search ..... 441/88, 102–123, 441/125, 129

[56] References Cited

U.S. PATENT DOCUMENTS

| | | | |
|---|---|---|---|
| 3,101,492 | 8/1963 | Martin | 441/114 |
| 4,263,686 | 4/1981 | Jarvis, Jr. | 441/116 |
| 4,276,670 | 7/1981 | Marchello et al. | 441/115 |
| 5,000,710 | 3/1991 | Bedortha et al. | 441/113 |

*Primary Examiner*—Edwin L. Swinehart

*Attorney, Agent, or Firm*—Willian Brinks Olds Hofer Gilson & Lione

[57] ABSTRACT

A lightweight, non-inflatable flotation device for assisting a person engaged natatorial activities or one engaged in aquatic therapy who might not otherwise be capable of performing such functions. The flotation device attaches to the extremities of the user to provide additional buoyancy. It is comprised of a elongate piece of relatively soft, pliable material, i.e., closed cell expanded polymer material, which is folded around the hand or foot of the user and held in place by retaining straps.

3 Claims, 1 Drawing Sheet

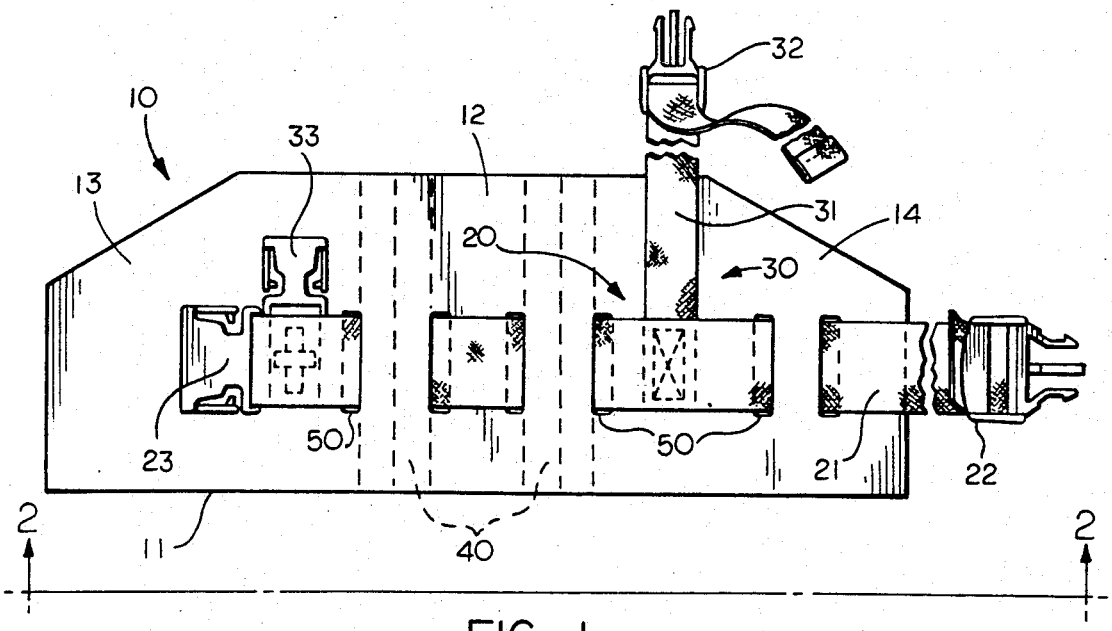
FIG. 1
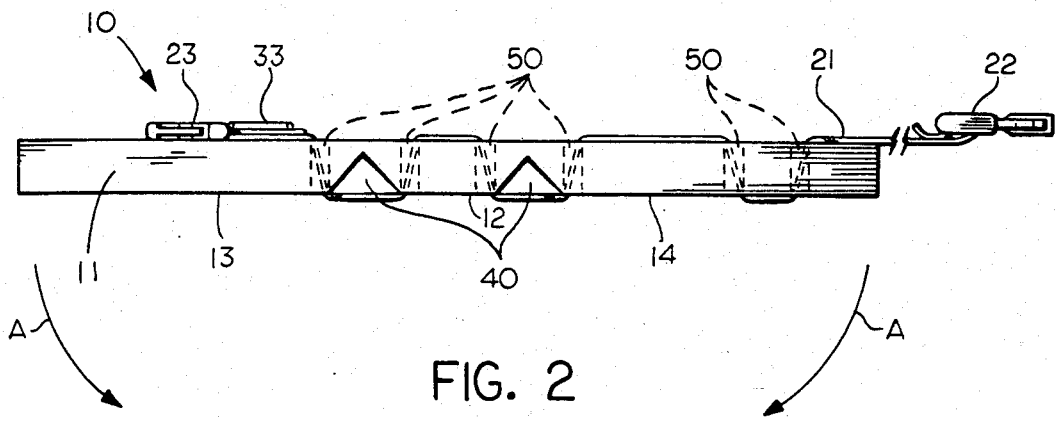
FIG. 2
FIG. 3
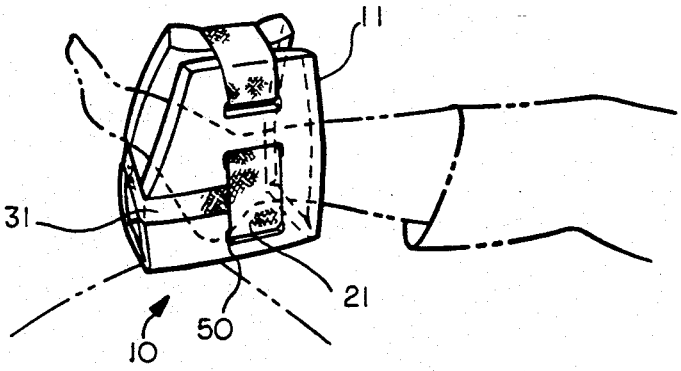

LIGHTWEIGHT NON-INFLATABLE FLOTATION DEVICE

BACKGROUND OF THE INVENTION

This invention relates to a lightweight, non-inflatable flotation device for assisting a person engaged in natatorial activities or one engaged in aquatic therapy who might not otherwise be capable of performing such functions. The advantages of exercise performed in water are well-known. It alleviates much of the stress imposed on the exerciser's joints; increases the exerciser's caloric consumption as the body attempts to counter the cooling effect of the water; and finally, makes the exercising experience more pleasant.

Unfortunately, not all people are able to take advantage of the benefits that water exercise provides. Persons having a fear of water or those lacking the knowledge of swimming are restricted to shallow water, reducing the effectiveness of the exercise. Physically challenged individuals may lack the necessary dexterity, agility, or strength required to participate in the various water exercise activities. Therefore a need exists for equipment which allows more people to participate in water-related activities. The present invention fulfills that need by providing additional buoyancy to the extremities of a user, alleviating many of the problems discussed above.

OBJECTS OF THE INVENTION

It is an object of the present invention to provide a lightweight, non-inflatable flotation device to assist a swimmer or person engaged in aquatic therapy by providing additional buoyancy.

It is a further object of this invention to provide a lightweight, non-inflatable flotation device which is attachable to a user's extremities.

It is yet a further object of the present invention to provide a lightweight, non-inflatable flotation device constructed of a relatively soft material to facilitate the comfort of the user as well as allow easy handling of the device out of the water.

SUMMARY OF THE INVENTION

The lightweight, non-inflatable flotation device of the present invention is comprised of an elongate section of uniformly thick, closed cell, expanded polymer material which is attached to the user's extremities by utilizing retaining strap assemblies. The flotation device has a series of in-line slotted openings positioned in the longitudinal direction. In the preferred embodiment, one adjustable flexible strap is woven through the series of longitudinal slots, and another flexible strap is attached normal to the longitudinal assembly by means of stitching. Both strap are made from lightweight, water-impervious materials, such as plastic and nylon webbing. Additionally, transverse V-shaped grooves are cut partially through the polymer material, effectively dividing the flotation device into separate sections and allowing it to be easily folded along the axes of the V-shaped grooves. By folding the device into a generally U-shaped arrangement and tightening the retaining straps using the adjustable buckles, the flotation device fits snugly around the user's hand or foot to provide additional buoyancy during natatorial activities or aquatic therapy.

Further, because the preferred embodiment of the flotation device is comprised entirely of lightweight materials, for example, closed cell foam, plastic and nylon, it is extremely easy to handle out of the water. This is especially important if the user is physically challenged, where the strength or dexterity required to wield bulky or heavy equipment is lacking.

The flotation device of the present invention makes use of the above advantages of water exercise while providing a means of assistance, i.e. additional buoyancy to the hands and/or feet of a user, thus allowing participation by those who might not otherwise be capable of performing such functions. For example, those persons affected by severe arthritis may lack the manual dexterity required to grip an exercise device. The present invention eliminates this problem by utilizing a flotation device which is attached to the extremities of the user, thus precluding the need for any gripping whatsoever. Similarly, those users who require assistance for leg exercises due to lack of leg strength would also be able to participate in water exercises by taking advantage of the additional buoyancy provided by the invention. Furthermore, these lightweight devices have little mass and cannot re-injure a leg or ankle joint as a heavier device might do.

BRIEF DESCRIPTION OF THE DRAWINGS

In the drawings:

FIG. 1 is an outer side view of the present invention in the fully extended position;

FIG. 2 is a cross-sectional view taken along line 2—2 of FIG. 1.

FIG. 3 is a perspective view of the present invention in the folded position as attached to the foot of a user;

DETAILED DESCRIPTION OF THE PREFERRED EMBODIMENT

In FIG. 1, the flotation device 10 is shown in the fully extended position. It is constructed of an elongate section of expanded polymer material 11 having in-line slotted openings 50 positioned longitudinally. The slotted openings are capable of receiving a longitudinal retaining assembly 20 which is comprised of a retaining strap 21, a male portion of an adjustable buckle 22, and the corresponding female portion of the buckle 23. In addition, the preferred embodiment of the present invention has a transverse retaining assembly 30 fastened to the longitudinal retaining assembly 20 by means of stitching or comparable method. The transverse retaining assembly 30 is comprised of a transverse retaining strap 31, a male portion of an adjustable buckle 32, and the corresponding female portion of the buckle 33. Ideally, the retaining straps 21 & 31 are made from nylon webbing or a comparable lightweight, water-impervious material. Also, the buckle portions 22, 23, 32, & 33 are made of plastic or other lightweight, water-impervious materials.

The present invention contains a pair of transverse V-shaped grooves 50 cut partially through the polymer section 11 which effectively divides the flotation device into separate sections, a bridge member 12 and two leg members 13 and 14. The V-shaped grooves 50 facilitate the folding of the flotation device 10 into a generally U-shaped arrangement which fits around the hand and/or foot of the user.

FIG. 2 is a cross-sectional view of the present invention in the fully extended position taken along line 2—2. As discussed above, the V-shaped grooves 50 extend partially through the thickness of the polymer section 11 to facilitate the folding of the flotation device 10 as indicated by directional arrows A. After inserting a hand or foot in the polymer piece 11 in a transverse position, the male portion of the adjustable buckle 22 is inserted into the female portion 23 and the retaining strap 21 of the longitudinal assembly 20 is gently tightened to insure a snug fit around the hand or foot. Similarly, the transverse retaining strap is buckled and tightened for additional support.

In the perspective view of FIG. 3, the flotation device 10 is shown properly affixed to the foot of a user. A hand or foot of a user is simply laid across the elongate section of polymer material 11 in a transverse position and the flotation device 10 is folded along the V-shaped grooves (not shown). Both retaining straps 21 & 31 are then tightened utilizing the adjustable buckles (not shown) to insure a snug fit, thus preventing the loss of the flotation device during swimming or aquatic therapy.

What is claimed is:

1. A lightweight, non-inflatable flotation device for use on an extremity of a wearer comprising, in combination:

an elongate buoyant section of polymer material having a pair of transverse V-shaped grooves extending across the minor dimension of said section generally parallel to each other, said transverse grooves defining a pair of folding lines such that said elongate section may be bent along said folding lines to form a generally U-shaped device, said device having a bridge member forming a rear support for the flotation device, said device further having a pair of leg members extending from said bridge member in a spaced apart relationship to provide an interior pocket for the wearer's extremity;

a plurality of in-line slotted openings extending along the length of said section, including both said leg and bridge members, to provide a path for interweaving a first adjustable length flexible strap therethrough in a direction normal to said V-shaped grooves; and a second adjustable-length flexible strap positioned normal to said first flexible strap and extending across an edge of said leg members to provide a bottom support for a wearer's extremity, both said flexible straps providing a means for tightly cinching said folded section around the extremity of the wearer.

2. The device of claim 1 wherein said elongate section further comprises said bridge member having a uniform width extending slightly beyond said pair of V-shaped transverse grooves and said leg members having a width which generally tapers to a width narrower than that of said bridge member width, said leg members having its outermost edges parallel to said transverse grooves.

3. The device of claim 2 wherein said polymer section is comprised of a closed-cell expanded polymer foam.

* * * * *